United States Patent [19]

Miyazaki

[11] Patent Number: 4,885,873

[45] Date of Patent: Dec. 12, 1989

[54] ABRADING APPARATUS FOR SPHERICALLY SHAPING WORKPIECES

[75] Inventor: Masashi Miyazaki, Tokyo, Japan

[73] Assignee: Seiko Electronic Components Ltd., Japan

[21] Appl. No.: 87,958

[22] Filed: Aug. 17, 1987

Related U.S. Application Data

[63] Continuation of Ser. No. 817,832, Dec. 17, 1985, abandoned.

[30] Foreign Application Priority Data

Apr. 17, 1984 [JP] Japan ..... 59-76849

[51] Int. Cl.[4] ..... B24B 13/00

[52] U.S. Cl. ..... 51/121; 51/284 R; 51/124 R

[58] Field of Search ..... 51/121, 55, 284 R, 133, 51/131.3, 131.2, 115, 124 R, 124 L

[56] References Cited

U.S. PATENT DOCUMENTS

| | | | |
|---|---|---|---|
| 1,937,459 | 11/1933 | Hill | 51/284 |
| 1,995,676 | 3/1935 | Gagnon et al. | 51/121 |
| 2,040,242 | 5/1936 | Courmettes | 51/284 |
| 2,465,702 | 3/1949 | Adams | 51/284 |

FOREIGN PATENT DOCUMENTS 57-102748 6/1982 Japan .

OTHER PUBLICATIONS

"Forming A Crown Surface on the End of a Rod-Like Element", Landstein, et al., IBM Technical Disclosure Bulletin vol. 20, No. 11a. Apr. 1978.

*Primary Examiner*—Frederick R. Schmidt
*Assistant Examiner*—Robert A. Rose
*Attorney, Agent, or Firm*—Bruce L. Adams; Van C. Wilks

[57] ABSTRACT

In this invention, the jig board fixing axis inserted in the eccentricity hole of the rotation axis rocks at rotation radius r without the rotation of the axis, the jig board set on the rocking jig board fixing axis is co-moved on through the spherical axis bearing, and then tip of the stick-like material is connected to the wheel spherical surface R by the self-weight of the jig board fixing axis and the jig board, ready to be ground and polished. And when the tip of the stick-like material connects orthogonally to the tangent direction of the spherical surface R, it is spherically processed by the rotation of the wheel and the rocking movement of the jig board.

16 Claims, 2 Drawing Sheets

ABRADING APPARATUS FOR SPHERICALLY SHAPING WORKPIECES

This is a continuation of application Ser. No. 817,832 filed Dec. 17, 1985, now abandoned.

FIELD OF TECHNOLOGY

The present invention relates to a device for grinding and polishing a tip of stick-like member spherically.

BACKGROUND OF THE INVENTION

In the prior art, when grinding and polishing the tip of a stick-like member spherically, the stick-like member is held at a rotational opening, in contact with the surface of the rotating wheel, and then ground and polished spherically by receiving a rocking movement at an angle corresponding to the complete spherical surface R, the supporting point being the axis of the stick-like member and the contact surface of the wheel. However this kind of device needs another device to maintain the accuracy of the wheel surface and the device itself is very complicated. Also, as this device needs the rotation of the stick-like member, this device is unsuitable for grinding long and fine materials.

The present invention is proposed to solve the above defects, and by equipping a spherical axis bearing on the jig board, the rotation of the stick-like member becomes unnecessary, and also by combining the use of above jig board and the rocking mechanism of the device itself, the need of the mechanism to maintain the surface accuracy of the wheel is solved, thereby offering a device which can grind and polish the spherical surface of the tip of a stick-like member with a simple mechanism.

THE DISCLOSURE OF THE INVENTION

The apparatus according to the present invention grinds and polishes the tip of the stick-like member with a simple mechanism where the jig board attached orthogonally to the surface of the spherical wheel, is mounted on the jig board fixing axis through the spherical axis bearing which freely adjusts the jig board relative to the spherical surface of the wheel.

THE BEST MODE OF CARRYING OUT THE INVENTION

Figure 1:
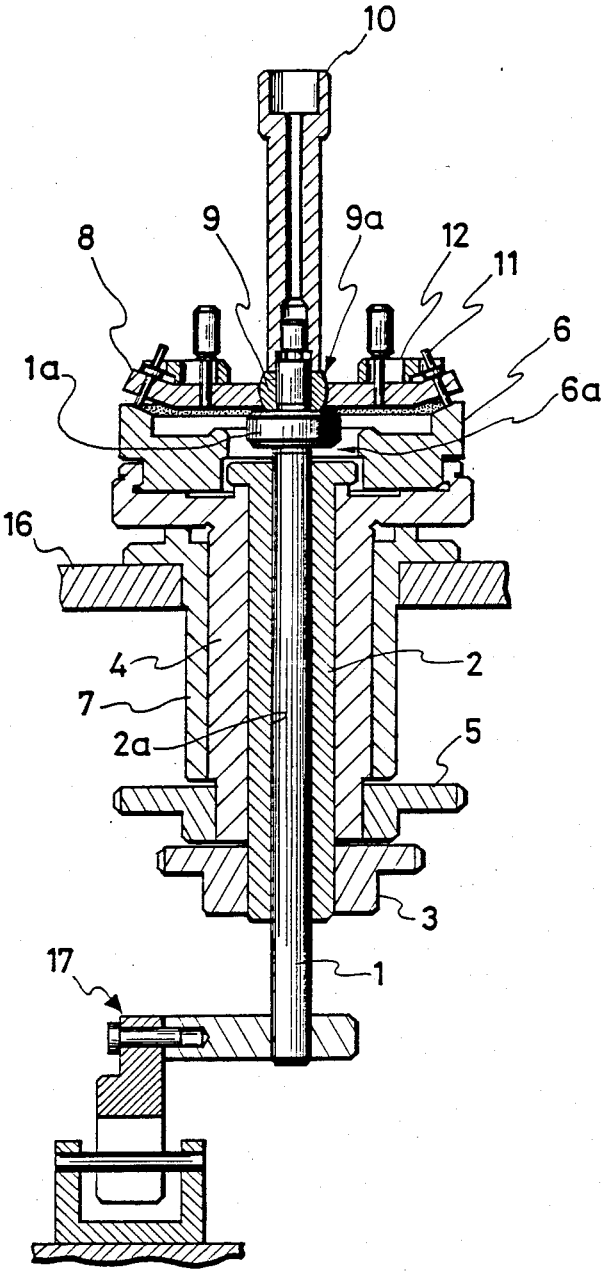
FIG. 1 shows a sectional structure of an embodiment according to the present invention.

Thorough explanation referring to the drawings showing an embodiment of carrying out the invention follows:

Referring to FIG. 1, reference numeral 1 designates a jig board fixing rod, and a flange 1*a* which bears a jig board 8 is formed on the upper part of the jig board fixing rod 1. This jig board fixing rod 1 is supported by a machine-body-base or frame 16, and extends through a rotation shaft or cylindrical inner shaft 2, a wheel shaft or hollow cylindrical outer shaft 4, and a shaft bearing 7. The rotation shaft 2 has an eccentricity through-hole 2*a* in which the jig board fixing rod 1 extending downwardly from the flange 1*a* is inserted axially slideably from upper position. The wheel shaft 4 has a hollow cylindrical structure which supports rotatably the rotation shaft 2; the shaft bearing 7 is also cylindrical and supports the wheel shaft 4 rotatably. The upper ends of the shaft bearing 7, wheel shaft 4 and rotation shaft 2, are formed in T-shape in section. The T-shaped part of shaft bearing 7 is supported by fixed to an attach hole of the machine body base 16, the T-shape part on the upper part of the wheel shaft 4 is held rotatably on the T-shape upper end of the shaft bearing 7 with its self-weight, and the T-shape part of rotation shaft 2 is held rotatably on the upper part of T-shape part of the wheel shaft 4 with its self-weight. As the rotation shaft 2 and the wheel shaft 4 are rotatively driven as stated below, the device does not increase the friction at the contacting part of these two shafts.

Figure 3:
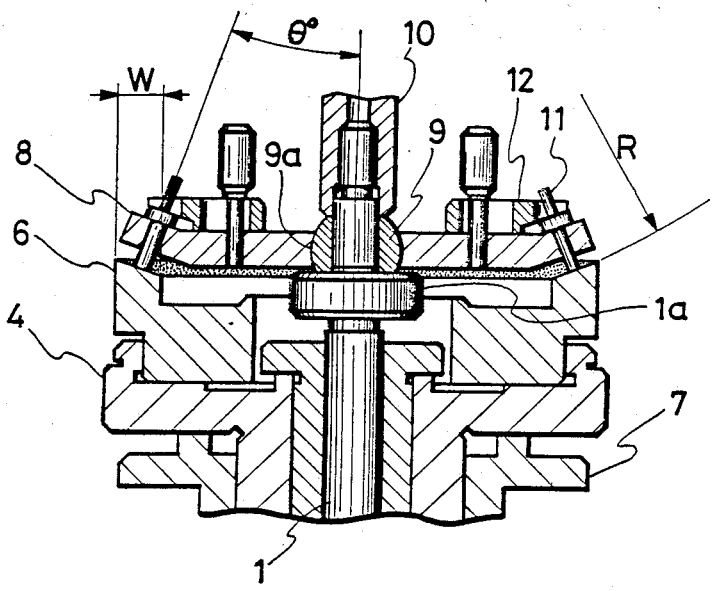
FIG. 3 shows the relation between the wheel surface, the stick-like material, and the jig board.

Meanwhile, the lower end of the wheel shaft 4 is extended below the lower end of the shaft bearing 7, and the lower end of the rotation shaft 2 is extended below the lower end of the wheel shaft 4, and the lower end of the jig board fixing rod 1 is extended below the lower end of the rotation shaft 2. Furthermore, a cog wheel 5 which gears into an unshown cog wheel is attached to the extended lower outer periphery of the the wheel shaft 4 and a cog wheel 3 which gears into another unshown drive cog wheel is fixed to the extended lower outer periphery of the rotation shaft 2. A device or support means 17 holds the extended lower end of the jig board fixing rod 1 for stopping or restraining the rotation of the jig bord fixing rod 1. An abrading wheel 6 is attached and fixed to the upper T-shape portion of the wheel shaft 4 with means of screws and such, and the abrading wheel 6 has an escape hole 6*a* which receives therethrough the said jig board fixing rod 1 including a flange 1*a* disposed on the upper end thereof, and the upper portion of the abrading wheel 6 forms an annular upper spherical abrading surface R which grinds and polishes a spherical surface of a stick-like member or workpiece 11. Referring to FIG. 3, the width W of the annular spherical abrading surface R is determined in accordance with the eccentricity quantity or gyratory radius of the eccentricity hole 2*a* formed in the rotation shaft 2 so that the stick-like member is rocked, ground and polished along the whole range of the width W. 8 shows the jig board which has means 12 along a peripheral portion thereof for holding the stick-like members 11, and the jig board 8 is fixed to the flange 1*a* of the jib board fixing rod 1 through a spherical or universal bearing 9. Therefore, this jig board 8 is possible to move freely or universally along a spherical surface 9*a* of the spherical bearing9. The plurality of the stick-like members 11 are attached onto this jig board 8 so that the surface thereof to be ground is orthogonal to the tangent direction of the upper spherical abrading surface of the wheel 6. Moreover, number 10 in FIG. 1 and FIG. 3 designates a locking fastening which fixes the spherical bearing 9 to the jig board fixing rod 1, and also acts as a weight applied to the stick-like members. Number 12 designates a metal fitting which fixes and supports the stick-like members 11 to the jig board 8.

Figure 2:
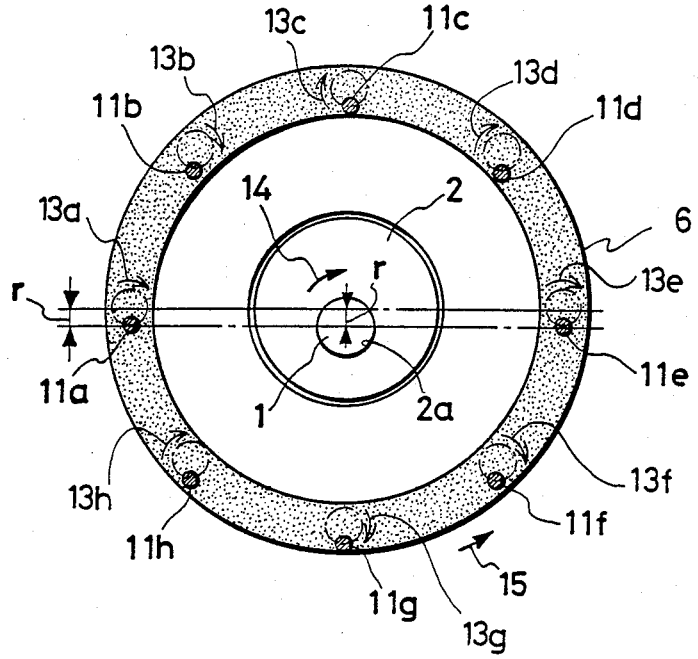
FIG. 2 shows the positional relation between the wheel and the jig board.

Explanation referring to FIG. 2 which shows the operation position or gyratory movement of the stick-like member 11 attached to the jig board 8 along the upper spherical abrading surface of the wheel 6 follows: First, in the state shown in FIG. 1, the wheel 6 rotates around a main axis of the wheel shaft 4 by unshown drive source in the direction of arrow 15 through the wheel shaft 4, and the rotation shaft 2 also rotates around the main axis by an unshown drive source in the direction of arrow 14 opposite to the wheel shaft 4. The jig board fixing rod 1 inserted in the eccentricity hole 2*a* undergoes a gyratory movement around the main axis along the locus of rotation-radius r in response to the movement of the the eccentricity hole 2*a* formed in this rotation shaft 2. At this point, the jig board fixing rod 1 is held by the rotation-stop-device or the support means 17 so that the jig board fixing rod 1 does not rotate around an axis thereof during the gyratory movement thereof. Therefore, each of the stick-like members 11*a*–11*h* set on the jig board 8 undergoes a corresponding gyratory movement along each of rocking locuses 13*a*–13*h* of radius r, same as the locus of rotation-radius r of the jig board fixing rod 1 because the jig board 8 is centrally connected to the top end of the jig board fixing rod 1 and undergoes the gyratory movement together therewith. Since each of the stick-like members 11*a*–11*h* is disposed in frictional contact with the upper spherical abrading surface R by the self-weight of the jig board fixing rod 1 and the jig board 8, each of the stick-like members 11*a*–11*h* can be ground and polished. At this point, each of the stick-like members 11*a*–11*h* rocks and undergoes the gyratory movement along each of the loci 13*a*–13*h* respectively on the spherical abrading surface R. Further, the jig board 8 undergoes an up-and-downwards rocking movement or adjusting movement around the spherical surface of spherical bearing 9 with respect to the spherical abrading surface R during the gyratory movement of the jig board 8. Eventually, the surface of the tip of stick-like member 11 is spherically processed by a fictional contact with the spherical abrading surface R. Though the method of forming the spherical abrading surface R in concavo-shape and forming the tip of the member in convexo-shape is explained in this embodiment, this apparatus can be operated in other ways, where the spherical abrading surface is formed convexo and the tip concavo. Also, the rotation-stop device is mounted to prevent the rotation of the jig board fixing rod, but there will be no influence on the grinding and polishing of the spherical surface even when the rotation-stop device is removed and the jig board fixing rod can rotate freely.

FIELD OF USE IN INDUSTRY

As stated as above, according to the present invention, the tip of long and fine stick-like member can be processed spherically, with a simple and improved mechanism having the spherical abrading surface of the wheel and the jig board on which the stick-like member is set without any addition of other parts, and this device can be used especially for grinding and polishing the tip of optical fiber connectors for use in optical communications, and so the industrial value and effect of this device is great.

What is claimed is:

1. A device for processing the tips of stick-like members spherically, comprising: a rotational wheel; a wheel shaft to which the wheel is fixed; a rotation shaft rotatably and coaxially supported by said wheel shaft within a hollow portion thereof to undergo rotation about an axis of rotation; a jig board fixing rod which is axially slidably inserted into an eccentricity hole eccentric from the rotational axis of said rotation shaft by a predetermined amount so that the jig board fixing rod undergoes a gyratory movement around the rotational axis of the rotation shaft; a jig board fixed to said jig board fixing rod for holding the stick-line members thereon so as to grind and polish the tips of the stick-like members in frictional contact with the wheel under the application of the weight of the jig board fixing rod and the jig board, said wheel having an abrading spherical surface contacting with the tips of the stick-like members; and a spherical bearing fixed to the jig board fixing rod for movably supporting the jig board therearound so as to enable the jig board to undergo an adjusting movement relative to the abrading spherical surface in response to the gyratory movement and the axial sliding displacement of the jig board fixing rod.

2. An abrading apparatus comprising: a hollow cylindrical outer shaft mounted to be rotationally driven around a main axis; a cylindrical inner shaft coaxially disposed within the hollow cylindrical outer shaft and mounted to be rotationally driven around the main axis in an opposite direction relative to the hollow cylindrical outer shaft, the cylindrical inner shaft having means defining a through-hole extending lengthwise therethrough eccentric from the main axis; a rod axially slidably disposed within the through-hole to undergo gyratory movement around the main axis in response to rotation of the cylindrical inner shaft; an abrading wheel fixed to the hollow cylindrical outer shaft for undergoing rotation around the main axis in response to rotation of the hollow cylindrical outer shaft, the abrading wheel having an upper spherical abrading surface; universal bearing means fixed to an end portion of the rod which extends upwardly through the abrading wheel; and jig means movably engaged around the bearing means in opposed relation to the upper spherical abrading surface for receiving the gyratory movement around the universal bearing means relative to the upper spherical abrading surface in response to the gyratory movement and the axial sliding displacement of the rod, the jig means having means for holding a plurality of workpieces along a peripheral portion thereof to align the same in frictional contact with the upper spherical abrading surface, whereby the jig means transmits the gyratory movement of the rod to the workpieces to cause the workpieces to undergo gyratory movement along the upper spherical abrading surface and maintains the workpieces in frictional contact with the upper spherical abrading surface during the gyratory movement through the adjusting movement relative to the upper spherical abrading surface.

3. An abrading apparatus according to claim 2; including support means for holding the rod to restrain the rotation of the rod during the gyratory movement thereof.

4. An abrading apparatus according to claim 3; wherein the support means includes means for holding the lower end of the rod which extends downwardly from the cylindrical inner shaft.

5. An abrading apparatus according to claim 2; including a shaft bearing for rotatably supporting the hollow cylindrical outer shaft.

6. An abrading apparatus according to claim 2; wherein the abrading wheel comprises an annular abrading wheel fixed around the hollow cylindrical outer shaft.

7. An abrading apparatus according to claim 6; wherein the hollow cylindrical outer shaft has means radially extending from an upper end thereof for receiving the annular abrading wheel thereon.

8. An abrading apparatus according to claim 2; wherein the upper spherical abrading surface comprises an annular upper spherical abrading surface.

9. An abrading apparatus according to claim 2; wherein the upper spherical abrading surface comprises a convex abrading surface.

10. An abrading apparatus according to claim 2; including a flange disposed at an upper end of the rod for supporting the universal bearing means thereof.

11. An abrading apparatus according to claim 10; including lock means for fastening the universal bearing means to the flange.

12. An abrading apparatus according to claim 2; wherein the universal bearing means comprises a spherical bearing.

13. An abrading apparatus according to claim 2; wherein the jig means has a weight sufficient to urge the workpieces into frictional contact with the spherical abrading surface.

14. An abrading apparatus according to claim 2; in combination with workpieces comprised of stick-like members.

15. An abrading apparatus according to claim 14; wherein the stick-like members comprise optical fiber connectors.

16. An abrading apparatus according to claim 14; wherein the means for holding the workpieces includes means for vertically aligning the stick-like members relative to the spherical abrading surface.

* * * * *